United States Patent [19]

Lowry

[11] 3,961,782

[45] June 8, 1976

[54] AID FOR FOLDING SHEETS AND THE LIKE

[76] Inventor: Edna Earl Lowry, 7308 Coronet, Tarrant County, Forth Worth, Tex. 76118

[22] Filed: Oct. 23, 1974

[21] Appl. No.: 517,329

Related U.S. Application Data

[63] Continuation-in-part of Ser. No. 303,064, Nov. 2, 1972, abandoned.

[52] U.S. Cl. ..... 270/61 R

[51] Int. Cl.[2] ..... B65H 45/00

[58] Field of Search ..... 35/69, 72, 64; 40/309; 223/37, 38, 1, 66, 52, 81; 38/141; 270/61; 428/188; 53/116–117

[56] References Cited

UNITED STATES PATENTS

| | | | |
|---|---|---|---|
| 2,717,779 | 9/1955 | Currie | 223/37 X |
| 2,742,388 | 4/1956 | Russell | 138/156 |
| 3,044,498 | 7/1962 | Barnes | 138/143 |
| 3,572,499 | 3/1971 | Mondano | 428/188 |

*Primary Examiner*—Edgar S. Burr
*Assistant Examiner*—A. Heinz

[57] ABSTRACT

The specification discloses a board for folding bed sheets, pillow cases, etc. into a unison and a uniform size for each bed size ensemble. It comprises a board having a square shape with two flexible tabs extending at a ninety degree angle opposite two of its parallel straight edges.

5 Claims, 9 Drawing Figures

31
30

31
30

31
30

31
30
33

31
38

AID FOR FOLDING SHEETS AND THE LIKE

This application is a continuation in-part of my prior application, Ser. No. 303,064, filed Nov. 2, 1972 and now abandoned.

A board used for measurement and a method of using the board for folding bed sheets and pillow cases of different sized beds in unison, along with folding each bed ensemble, into a uniform size for storage and readiness of the bed sheets.

A board formed in a square shape 8¼ inches × 8¼ inches and having four 90° angles at its top and bottom surface. It is ¼ inch thick. Two flexible tabs 7 inches long and ¾ inches wide are doubled and are secured with binding glue midway center on their opposit straight edges allowing 1 inch on each end of the tabs for the glued width.

The tabed edges are used as a wedge to pry in and among while using for a measured width, along with and retrieving the board while being used for a measured width. The untabbed edges are used after the width has been established because of the wear and tear on the tabs the board is turned with the tabbed edges running parellel to the assemblage length which allows the tabs to be used to retrieve the board from the sheets at the final stage of folding the sheets.

The flat plane or smooth surfaces of the board is used for measurement along with a support when the board is being rolled or rotated over and against a base for folding the sheets into a unison, along with a uniform size.

The board may be bound in cloth, leaving the tab edges to extend, with a pocket insert on one side so that sachet or perfume tissue can be stored to place into the pocket that has been formed in folding the sheets. The sachet and perfumed tissue can be at finger tip when the board is being used.

A method of folding king, regular, or twin sized sheets and their bottom contour sheets and pillow cases into a unison and a uniform size for a proper bed sized ensemble, which comprises:

Positioning the flat top sheet, halved and quartered on a flat surface and the contour sheet halved and quartered, with contour corners tucked within each other and the outer edges folded at an angle, leaving contour contour corners smooth to be flattened, extending the contour portion of the contour sheet the width of the board and place it on the top sheet, the pillow cases, being spread flat one on the other at the opposit ends of the contour corners of the flattened assemblage to be folded, bringing the remainder of the bottom portion of the sheet over the prepared sheets half way to secure a smooth working surface. The method of folding being carried out by using a board which comprises:

A board formed in a square shape 8¼ inches × 8¼ inches having four 90° angles at its top and bottom edges. It is ¼ inch thick with a flat plane extending on the top and bottom surfaces. Flexible tabs made of cloth or vinal are secured with adhesive on both the flat plane surfaces extend 2½ inches at right angle running parallel on the straight edges allowing 1 inch each on both the flat surfaces, at the two parelle straight edges to secure the tabs.

The method of folding comprising the steps of

Positioning the board on top mid center of the folded assemblage with a tab extending over the elongated assemblage with its straight edges parellel with the top straight edges of the sheet assemblage.

Rotating or rolling the positioned flattened assemblage over with said board from one tabbed edge to the other tabbed edge, removing the board by pulling the board out and down a measured width with the visible tab as seen in FIG. 3.

Measuring the extending width below the bottom of the board up the width of the board and if needed fold it by rotating the fold over the board until the width of the board is obtained as seen in FIG. 4.

Wrap or roll upward to the opposite end along the top of the fold to produce an enlongated folded assemblage of a definite width with the board.

Removing the board by pulling upward on the free tab as seen in FIG. 6.

Continueing to fold by turning the board around with the tabbed edges parellel to the lengthwise assemblage and wrap the contour portion over the board. Rotate the board twice in wrapping and a pocket appears on the upper surface to store sachet or perfume tissue into the pocket. Continue to roll or wrap until the raw of the assemblage is within a measurable width as seen in FIG. 8 bring the folded assemblage back for measure and fold the raw edge portion toward the folded assemblage and press down on the board for an even and smooth fold to be obtained with the edges tucked within the folding assemblage.

Remove the board either by pulling the tab or the board from the sheets as seen in FIG. 9.

BACKGROUND OF THE INVENTION

My present invention and the improvement relates generally to folding bed sheets and in the art of folding the twin top, regular top, king or queen top sheets and their bottom contour sheets along with the pillow cases for a matched bed ensemble for different sized beds into a unison and a uniform size. This will enable a selection for a proper bed ensemble without distrubing portions of the linens stored in the closet.

SUMMARY OF THE INVENTION

It is an object of the present invention and the improvement of, to provide a simple, economic and easy to use board for the folding of bed sheets and pillow cases, into a unison and a uniform size. The board is formed of a ridged material in a perfect square shape with smooth top and bottom surfaces. Two flexible tabs are connected to opposit straight edges extending at a right angle.

DETAILED DESCRIPTION OF THE INVENTION AND THE IMPROVEMENTS

Figure 1:
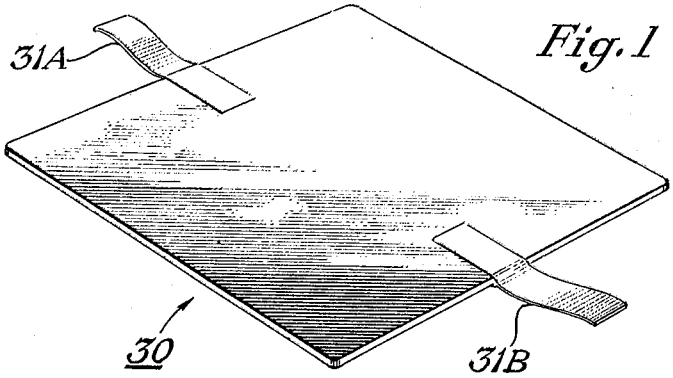
FIG. 1 is a perspective view of the folding board of the present invention and the improvement thereof.

Referring now to the drawings, the board is identified at 30 which is a perfect square shape. In addition, two flexible tabs 31A and 31B are connected to opposit straight edges of the board 30 and are employed to pull the board 30 from the sheets 35 along with having a visible extension for a measured width to slide and pull the board.

In one embodiment, the board 30 is formed of a relatively rigid plastic sheet or metal or wood having a thickness of ¼ inch. The board 30 is a perfect square and has dimensions of 8¼ inches × 8¼ inches.

Figure 2:
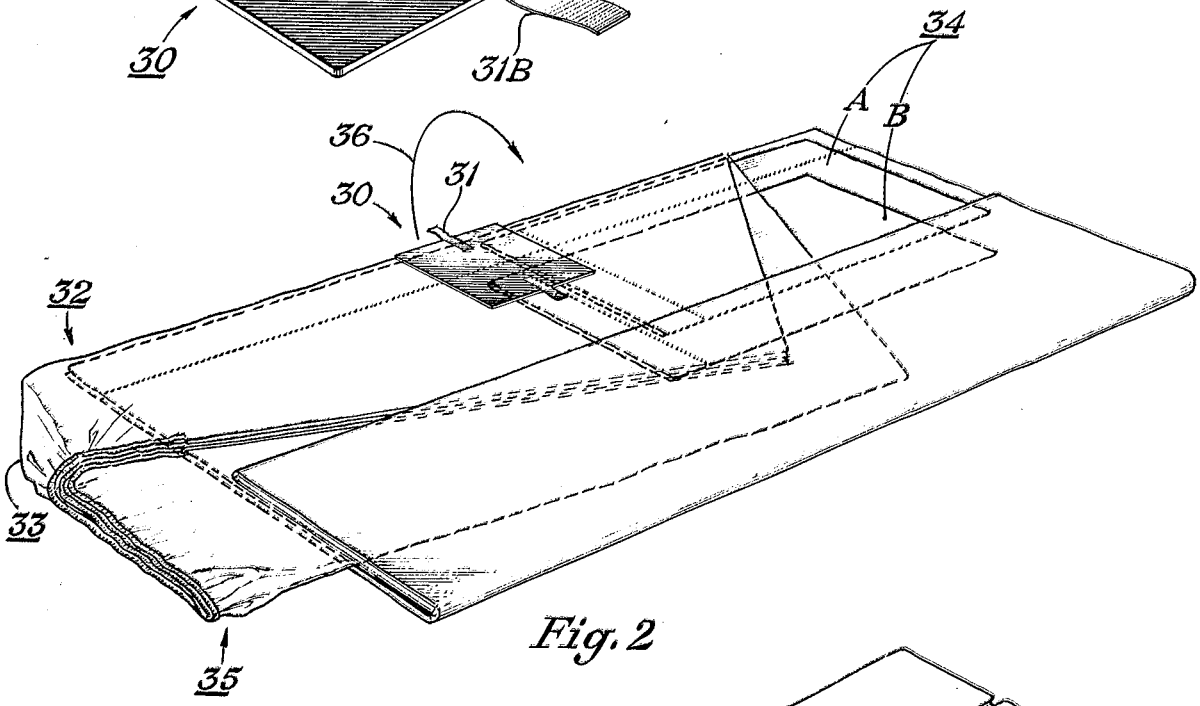
FIG. 2–9 illustrate the manner in which the board of the present invention and the improvement of, is employed for folding bed sheets and pillow cases for the different sized beds and how they are folded in a unison and a uniform size.

Referring now to FIGS. 2–9, there will be discribed one example in which the board 30 is used to fold bed sheets 35. In FIG. 2 a conventional sheet is identified at 32 while a contoured sheet is identified at 33. In addition two pillow cases are illustrated at 34. In the process to be described, the two sheets and pillow cases are to be folded together to form a single unit or a unison and a uniform size.

Figure 3:
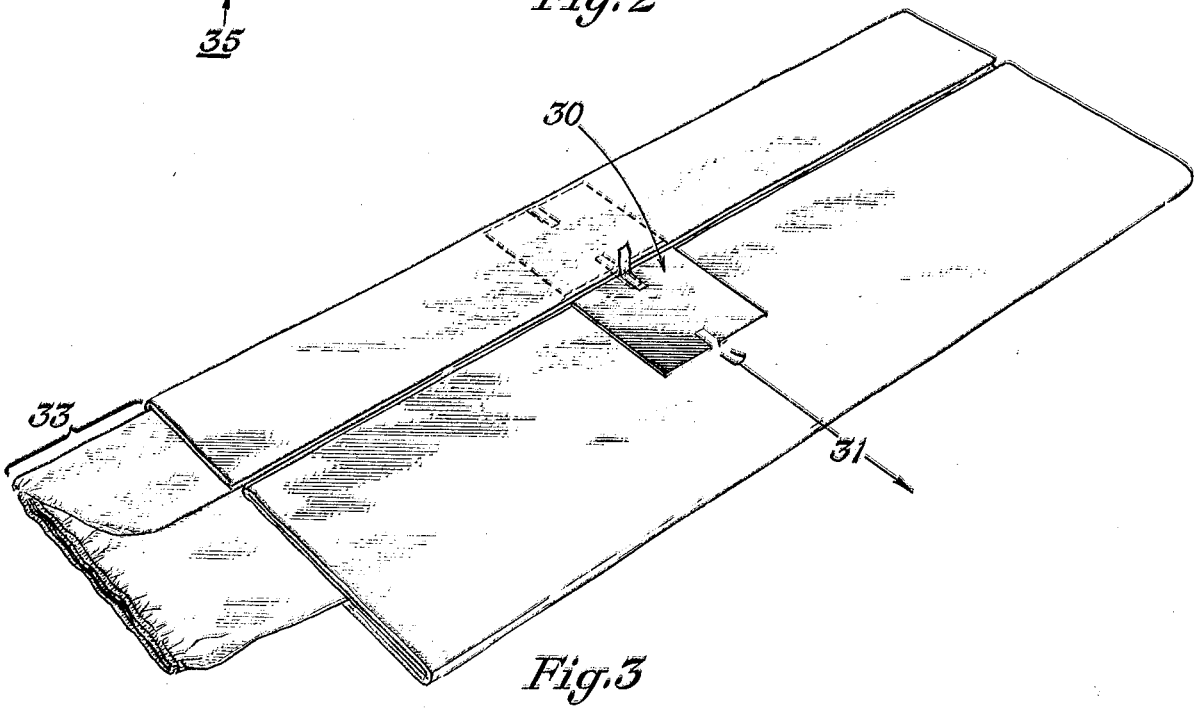

The conventional sheet 32 is halved and quartered and laid on a flat surface as illustrated in FIG. 2. The contoured sheet 33 will be halved and quartered with the contour corners tucked one within the other and folded to an angle and laid on the straight edge of the top sheet 32 as illustrated in FIG. 2. The pillow cases 34A and 34B are placed flat one on the other at opposit end of the contour sheet 33. Bringing the extended bottom portion of the conventional sheet 32 over the prepared sheets 35 half way to secure a smooth surface. Place the board 30 at the upper edge of the prefolded sheets 35 with the tab 31 extending beyond the straight edge of 35 and rotate or roll over with the sheets 35 in the direction of the arrow 36 to form the partially folded section illustrated in FIG. 3 remove the board 30 by pulling the visible tab 31 forward and down a measured width as seen in FIG. 3.

Figures 4, 5, 6, 7, 8, 9:
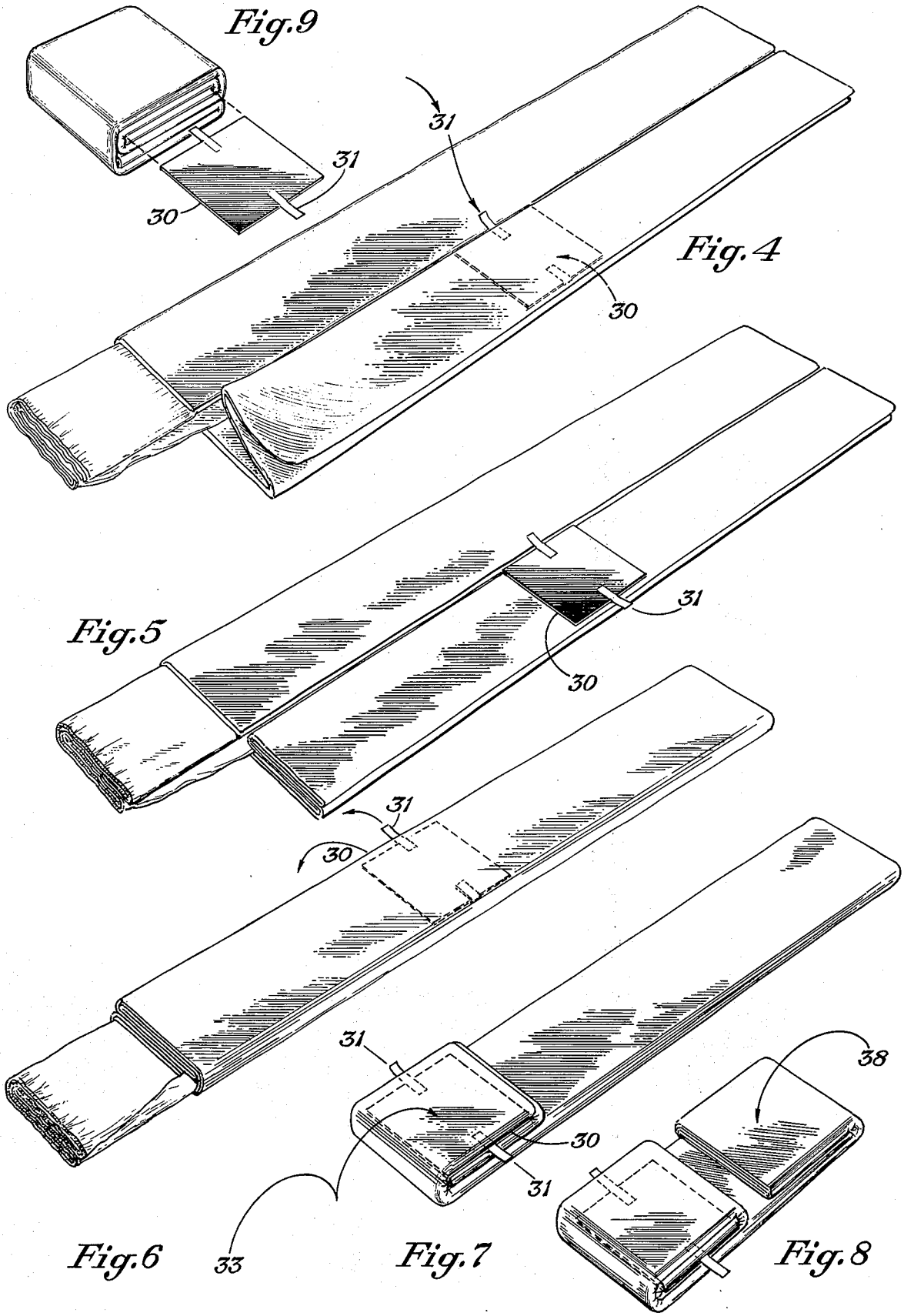

Measuring the extending width below the bottom of the board 30 up the width of the board 30 with the extended tab 31 extended over the folded section, roll or rotate a measured width over the board 30 as seen in FIG. 4. Remove the board 30 with the tab 31 and place it on top of the premeasured width as seen in FIG. 5.

Wrap or roll upward to the opposit end along the top of the fold to produce an elongated folded assemblage of a definite width. Remove the board 30 by pulling upward on the free tab 31 as seen in FIG. 6.

Continueing to fold by turning the board 30 with the tabs 31 positioned parellel to the lengthwise assemblage and wrap the contour sheet portion 33 over the board 30 as seen in FIG. 7. Rotate the board 30 two rotations and a pocket will be wedged 37 to store sachet or perfume tissue into the pocket. Continueing to roll or wrap until the raw edge 38 portion toward the folded assemblage and press down on the board 30 with the fold for an even and smooth fold to be obtained with the edges tucked within the folding assemblage as seen in FIG. 9. Remove the board 30 by pulling tab 31 as seen in FIG. 9.

I claim:

1. Apparatus for folding sheets and pillow cases into unitary assemblages of a uniform size comprising:

a rigid board member of relatively thin thickness having top and bottom flat surfaces and four straight peripheral edge surfaces including first and second pairs of opposite generally parallel edge surfaces, and a pair of flexible tab members mounted on said board member with one tab member being mounted along one of the opposite generally parallel edge surfaces of one of the pairs of edge surfaces and extending outwardly therebeyond and the other tab member being mounted along the other one of the opposite generally parallel edge surfaces of the one of the pairs of edge surfaces and extending outwardly therebeyond.

2. The invention as defined in claim 1 and wherein said board member having a square peripheral shape defined by said edge surfaces.

3. The invention as defined in claim 2 and wherein said board member having a peripheral size of approximately 8 inches by 8 inches and a thickness of approximately ¼ inch.

4. The method of folding sheets and pillow cases into unitary assemblages of uniform size comprising the steps of:

folding a first sheet into a quarter normal size condition with at least one straight edge, folding a second sheet into a quarter normal size condition with at least one straight edge, placing the first and second folded sheets one on top of the other on a flat support surface with the straight edges substantially aligned, placing pillow cases on top of the folded sheets with straight edges of the pillow cases substantially aligned with the straight edges of the folded sheets, placing a flat board member having straight peripheral edge surfaces on top of a portion of the folded sheets and on top of a portion of the pillow cases with the one of the straight peripheral edges substantially aligned with the substantially aligned straight edges of the folded sheets and the pillow cases, further folding the folded sheets and the pillow cases into a first assemblage of successive uniform width elongated folds extending parallel to the substantially aligned straight edges by making each elongated fold over the board member and then moving the board member transversely to each elongated fold after formation of each elongated fold to measure the width of each successive elongated fold and obtain uniform width elongated folds in the first assemblage, removing the board member from the first assemblage and placing the board member on top of the first assemblage along one transverse edge thereof, and further folding the first assemblage of folded sheets and pillow cases into a second assemblage of successive uniform width transverse folds extending transverse to the substantially aligned straight edges and transversely to the elongated folds by making each transverse fold over the board member and by then moving the board member parallel to the elongated folds after formation of each transverse fold to measure the width of each successive transverse fold and obtain uniform width transverse folds in the second assemblage.

5. The method as defined in claim 4 and further comprising the step of making the elongated folds and the transverse folds of the same width.

* * * * *